United States Patent [19]

Seifert

[11] 4,360,735

[45] Nov. 23, 1982

[54] X-RAY TUBE COMPRISING TWO CATHODE COILS

[75] Inventor: Gerd Seifert, Spardorf, Fed. Rep. of Germany

[73] Assignee: Siemens Aktiengesellschaft, Berlin & Munich, Fed. Rep. of Germany

[21] Appl. No.: 232,194

[22] Filed: Feb. 6, 1981

[30] Foreign Application Priority Data

Mar. 4, 1980 [DE] Fed. Rep. of Germany ..... 3008304

[51] Int. Cl.[3] ..... H05G 1/10; H05G 1/00; H01J 35/00; H01J 35/04

[52] U.S. Cl. ..... 378/134

[58] Field of Search ..... 250/421, 402; 313/56, 313/60

[56] References Cited

U.S. PATENT DOCUMENTS 3,110,810 11/1963 Fransen ..... 250/402
3,119,931 1/1964 Fransen et al. ..... 250/402
3,452,203 6/1969 Shiga et al. ..... 313/56
3,991,314 11/1976 Schmitman et al. .

*Primary Examiner*—Alfred E. Smith
*Assistant Examiner*—T. N. Grigsby
*Attorney, Agent, or Firm*—Hill, Van Santen, Steadman, Chiara & Simpson

[57] ABSTRACT

In an exemplary embodiment, a housing of shielding material, surrounding the cathode coils, has an opening for the transmission of the stream of electrons to the anode. A device for effecting a relative movement between the housing and the cathode coils is present, by means of which one of the cathode coils is selectively capable of being covered. The cathode coils can be mounted on a holder which is pivotal about the x-ray tube longitudinal axis by means of electromagnets. The electromagnets can be connected to the output of the filament supply transformer, associated with the respective cathode coil, and a multiplex circuit can be provided for the transmission of the control signals.

3 Claims, 2 Drawing Figures

X-RAY TUBE COMPRISING TWO CATHODE COILS

BACKGROUND OF THE INVENTION

The invention relates to an x-ray tube comprising two cathode filament coils, one of which, respectively, serving the purpose of generating the x-radiation, comprising a housing comprised of shielding material which surrounds the cathode coils, which housing exhibits an opening for releasing the stream of electrons to the anode.

In the case of x-ray tubes of this type, only one cathode coil, respectively, is employed corresponding to the respectively desired focus. The selective connection (or switching-on) of the respectively employed focus proceeds electrically in the case of the known x-ray tubes. This has as a consequence that, for example, during transition from fluoroscopy to radiography, a relatively great amount of time elapses during the heating up of the respective cathode coil.

SUMMARY OF THE INVENTION

The object underlying the invention resides in producing an x-ray tube of the type initially cited in which the two cathode coils can be heated independently of one another, so that a rapid transition from a fluoroscopy to a radiography is possible.

In accordance with the invention, this object is achieved in that the housing possesses a single opening, and that means are present for generating a relative movement between the housing and the cathode coils, by means of which one of the cathode coils is selectively capable of being covered. In the inventive x-ray tube, a mechanical covering of one cathode coil, respectively, takes place. The respectively covered cathode coil can therefore already be heated for a radiograph during fluoroscopy.

It is expedient to mount the cathode coils on a holder which is electromagnetically pivotal about the x-ray tube longitudinal axis. The electromagnets for the holder-pivoting can be arranged at the output of the filament supply transformer associated with the respective cathode coil, and a multiplex circuit can be provided for the transmission of the control signals. In the case of this design, the filament supply transformers for the two cathode coils are also employed for the transmission of the control signals for the electromagnets for the purpose of mechanical movement of the cathode coils.

The invention shall be explained in greater detail in the following on the basis of an exemplary embodiment illustrated on the accompanying drawing sheet; and other objects, features and advantages will be apparent from this detailed disclosure and from the appended claims.

BACKGROUND OF THE INVENTION

FIG. 1 illustrates a view of the cathode section of an inventive x-ray tube as seen from the anode; and FIG. 2 illustrates a circuit for the operation of the x-ray tube according to FIG. 1.

DETAILED DESCRIPTION

Figure 1:
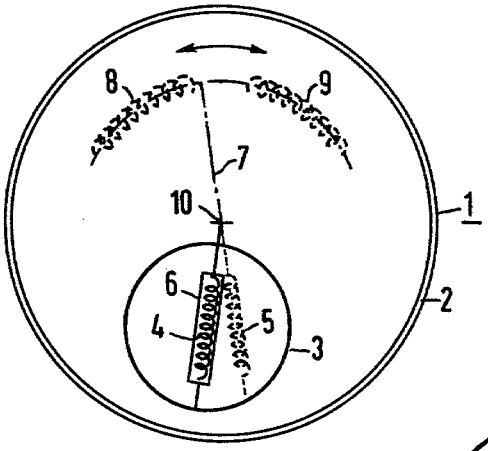

In FIG. 1, the cathode section 1 of an x-ray tube is illustrated which exhibits a housing 2 comprised of shielding material which is provided with a cathode head 3. In the interior of the cathode head 3 there are two cathode coils 4, 5. The cathode head 3 likewise is comprised of shielding material in which a slot 6 is provided which permits the electrons to emerge from one cathode coil, respectively, to the anode.

The cathode coils 4 and 5 are mounted on a holder 7 which is pivotal about the longitudinal axis 10 of the x-ray tube in the direction of the double arrow by means of two magnet coils 8, 9. The pivoting path is here so selected that, upon excitation of the coil 8, the cathode coil 4 is disposed in alignment with the slot 6 in the cathode head 3, and, upon excitation of the coil 9, the cathode coil 5 is disposed in alignment with the slot 6 in the cathode head 3. The holder 7 can be locked in each of its end positions. Corresponding to the position of the holder 7, the stream of electrons from one cathode coil, respectively, is released to the anode.

Figure 2:
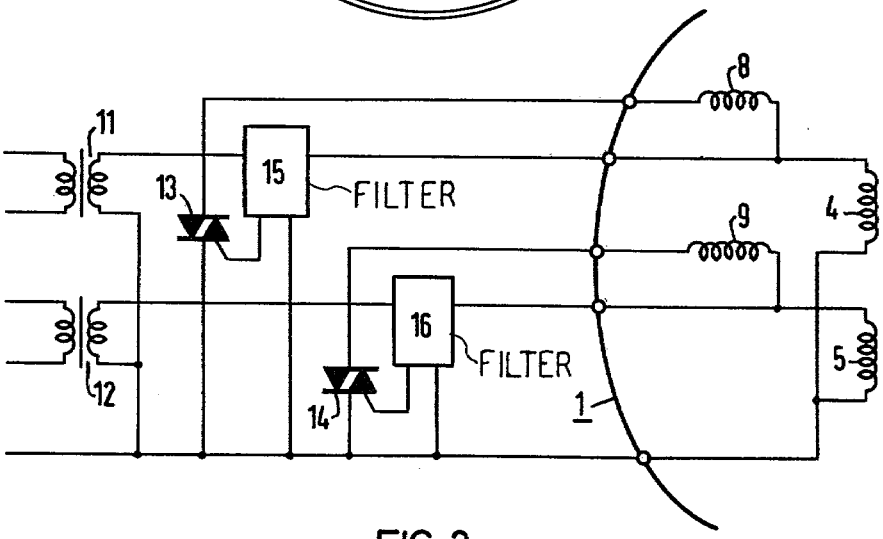

In FIG. 2 the cathode section of the x-ray tube is represented in a circuit-type illustration. The cathode coils 4 and 5 are fed by two filament supply transformers 11 and 12. On the secondary side of the filament supply transformers 11 and 12 the coils 8 and 9 are connected in unipolar fashion. The connection of the coils 8 and 9 to the mains (or supply line) voltage proceeds by means of triacs 13 and 14 which are ignited (or fired) with signals which arrive via the filament supply transformers 11 and 12, and which are directed to the triacs by means of filters 15 and 16. The filters 15 and 16 are disposed in the secondary circuit of the filament supply transformers 11 and 12 and are transmissive for a control frequency, superimposed on the heating (or filament) frequency, for the purpose of ignition of the triacs 13 and 14. The filters 15 and 16, in principle, represent a multiplex circuit for the double exploitation of each filament supply transformer; namely, for the heating and for the selective connection (or switching-on) of the magnet coils 8 and 9, and hence for the movement of one of the heating coils 4, 5, respectively, into alignment with the slot 6.

It is possible to arrange the magnet coils outside the vacuum receptacle of the x-ray tube and to allow them to act on low-retentivity (or soft-magnetic) adjustment parts for the cathode coils in the vacuum receptacle.

It will be apparent that many modifications and variations may be effected without departing from the scope of the novel concepts and teachings of the present invention.

I claim as my invention:

1. An x-ray tube comprising two cathode coils selectively, operable for generating the x-radiation, a housing comprised of shielding material which surrounds the cathode coils, said housing providing a path for the purpose of transmitting the stream of electrons from the active one of said cathode coils, the housing (2, 3) having a single opening (6), and means (7, 8, 9) for generating a relative movement between the housing (2, 3) and the cathode coils (4, 5), by means of which one of the cathode coils (4, 5) is selectively capable of being covered by the shielding material, while the other of the cathode coils (4, 5) is in alignment with said single opening.

2. An x-ray tube according to claim 1, with a holder mounting the cathode coils (4, 5) so as to be electromagnetically pivotal about an x-ray tube longitudinal axis (10).

3. An x-ray tube according to claim 2, with electromagnets (8, 9) for effecting pivotal movement of the holder, filament supply transformer means (11, 12), associated with the respective cathode coils (4, 5) and connected with the respective electromagnets, and a multiplex circuit (15, 16) for controlling the transmission of the control signals for selecting the activation of the respective electromagnets.

* * * * *